US011399593B2

(12) United States Patent
Cross et al.

(10) Patent No.: US 11,399,593 B2
(45) Date of Patent: Aug. 2, 2022

(54) ARTICLE OF FOOTWEAR WITH AUXETIC SOLE STRUCTURE HAVING A FILLED AUXETIC APERTURE

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 694 days.

(21) Appl. No.: 15/604,707

(22) Filed: May 25, 2017

(65) Prior Publication Data

US 2018/0338571 A1 Nov. 29, 2018

(51) Int. Cl.

| | |
|---|---|
| ***A43B 13/18*** | (2006.01) |
| ***A43B 13/12*** | (2006.01) |
| ***A43B 13/04*** | (2006.01) |
| ***A43B 13/14*** | (2006.01) |
| ***A43B 7/148*** | (2022.01) |

(52) U.S. Cl.

CPC ..... *A43B 13/186* (2013.01); *A43B 7/148* (2013.01); *A43B 13/04* (2013.01); *A43B 13/12* (2013.01); *A43B 13/125* (2013.01); *A43B 13/141* (2013.01); *A43B 13/181* (2013.01); *A43B 13/188* (2013.01)

(58) Field of Classification Search

CPC ... A43B 13/186; A43B 13/181; A43B 13/188; A43B 13/12; A43B 13/122; A43B 13/42; A43B 13/18; A43B 13/187; A43B 7/148; A43B 1/0009

USPC ..... 36/102, 25 R, 28, 30 A

See application file for complete search history.

(56) References Cited

U.S. PATENT DOCUMENTS

| | | | | |
|---|---|---|---|---|
| 2,885,797 A * | 5/1959 | Chrencik | A43B 13/186 36/104 |
| 4,364,188 A * | 12/1982 | Turner | A43B 5/06 36/129 |
| 4,616,431 A * | 10/1986 | Dassler | A43B 13/181 36/28 |
| 4,680,875 A * | 7/1987 | Danieli | A43B 13/181 36/25 R |
| 5,046,267 A | 9/1991 | Kilgore et al. | |
| 6,266,896 B1 * | 7/2001 | Liu | A43B 13/12 36/28 |

(Continued)

FOREIGN PATENT DOCUMENTS

| | | |
|---|---|---|
| CN | 2293224 Y | 10/1998 |
| CN | 201929111 U | 8/2011 |

(Continued)

*Primary Examiner* — Heather Mangine

(74) *Attorney, Agent, or Firm* — Quinn IP Law

(57) ABSTRACT

An article of footwear includes a sole structure with an auxetic structure and a filler. The auxetic structure includes an aperture. The filler is received in the aperture. The auxetic structure is configured to deform auxetically. The sole structure is configured to deform between a neutral position and a deformed position. The aperture is configured to deform as the sole structure deforms between the neutral and deformed positions. The auxetic structure includes a first material and the filler includes a second material. The second material is softer than the first material.

5 Claims, 11 Drawing Sheets

(56) References Cited

U.S. PATENT DOCUMENTS 7,910,193 B2 * 3/2011 Ma ..... A47C 23/002 428/218
8,084,117 B2 * 12/2011 Lalvani ..... B32B 3/266 428/135
10,064,448 B2 * 9/2018 Langvin ..... A43B 5/06
10,226,098 B2 * 3/2019 Guyan ..... A43B 13/127
2005/0268490 A1 * 12/2005 Foxen ..... A43B 7/1425 36/28
2006/0000119 A1 * 1/2006 Endo ..... A43B 7/142 36/141
2006/0130364 A1 * 6/2006 Greene ..... A43B 3/24 36/28
2008/0250673 A1 * 10/2008 Andrews ..... A43B 13/12 36/25 R
2009/0183392 A1 * 7/2009 Shane ..... A43B 1/0027 36/97
2011/0099845 A1 * 5/2011 Miller ..... A43B 7/142 36/91
2011/0168313 A1 * 7/2011 Ma ..... B60C 7/14 152/302
2012/0210606 A1 * 8/2012 Gheorghian ..... A43B 5/06 36/103
2013/0055596 A1 * 3/2013 Wan ..... A43B 13/141 36/25 R
2013/0264757 A1 10/2013 Rajasekaran et al.
2014/0101816 A1 * 4/2014 Toronjo ..... A41D 31/02 2/69
2014/0109286 A1 * 4/2014 Blakely ..... A41D 31/02 2/69
2014/0117165 A1 5/2014 Baudasse et al.
2014/0250720 A1 * 9/2014 Miner ..... A43B 13/20 36/29
2015/0075034 A1 3/2015 Cross et al.
2015/0245683 A1 * 9/2015 Cross ..... B32B 27/065 36/103
2015/0245685 A1 9/2015 Cross et al.
2015/0374070 A1 12/2015 Tawney et al.
2016/0242502 A1 * 8/2016 Spanks ..... A43B 13/20
2016/0262491 A1 * 9/2016 Cross ..... A43B 13/14
2016/0353838 A1 12/2016 Takeshita et al.
2016/0360828 A1 * 12/2016 Guyan ..... A43B 13/186
2017/0042285 A1 2/2017 Lawless
2017/0156443 A1 * 6/2017 Guyan ..... A43B 23/027
2017/0202304 A1 * 7/2017 Ng ..... A43B 13/186
2017/0332727 A1 * 11/2017 Beck ..... A43B 7/146
2017/0340058 A1 * 11/2017 Madore ..... A43B 5/001
2018/0317600 A1 * 11/2018 Campos ..... A43B 13/186
2018/0325216 A1 * 11/2018 Toronjo ..... A43B 23/026
2018/0338572 A1 * 11/2018 Cross ..... A43B 3/0073

FOREIGN PATENT DOCUMENTS

CN 202618488 U 12/2012
CN 204181024 U 3/2015
CN 204653946 U 9/2015
WO WO-2016077443 A1 * 5/2016 ..... A43B 5/02

* cited by examiner

ARTICLE OF FOOTWEAR WITH AUXETIC SOLE STRUCTURE HAVING A FILLED AUXETIC APERTURE

BACKGROUND

The following relates to an article of footwear and, more particularly, relates to an article of footwear with an auxetic sole structure that includes one or more fillers.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure incorporates an insole, a midsole, and an outsole.

BRIEF DESCRIPTION OF THE DRAWINGS

The present disclosure can be better understood with reference to the following drawings and description. The components in the figures are not necessarily to scale, unless noted herein. Moreover, in the figures, like reference numerals designate corresponding parts throughout the different views.

DETAILED DESCRIPTION

Figure 1:
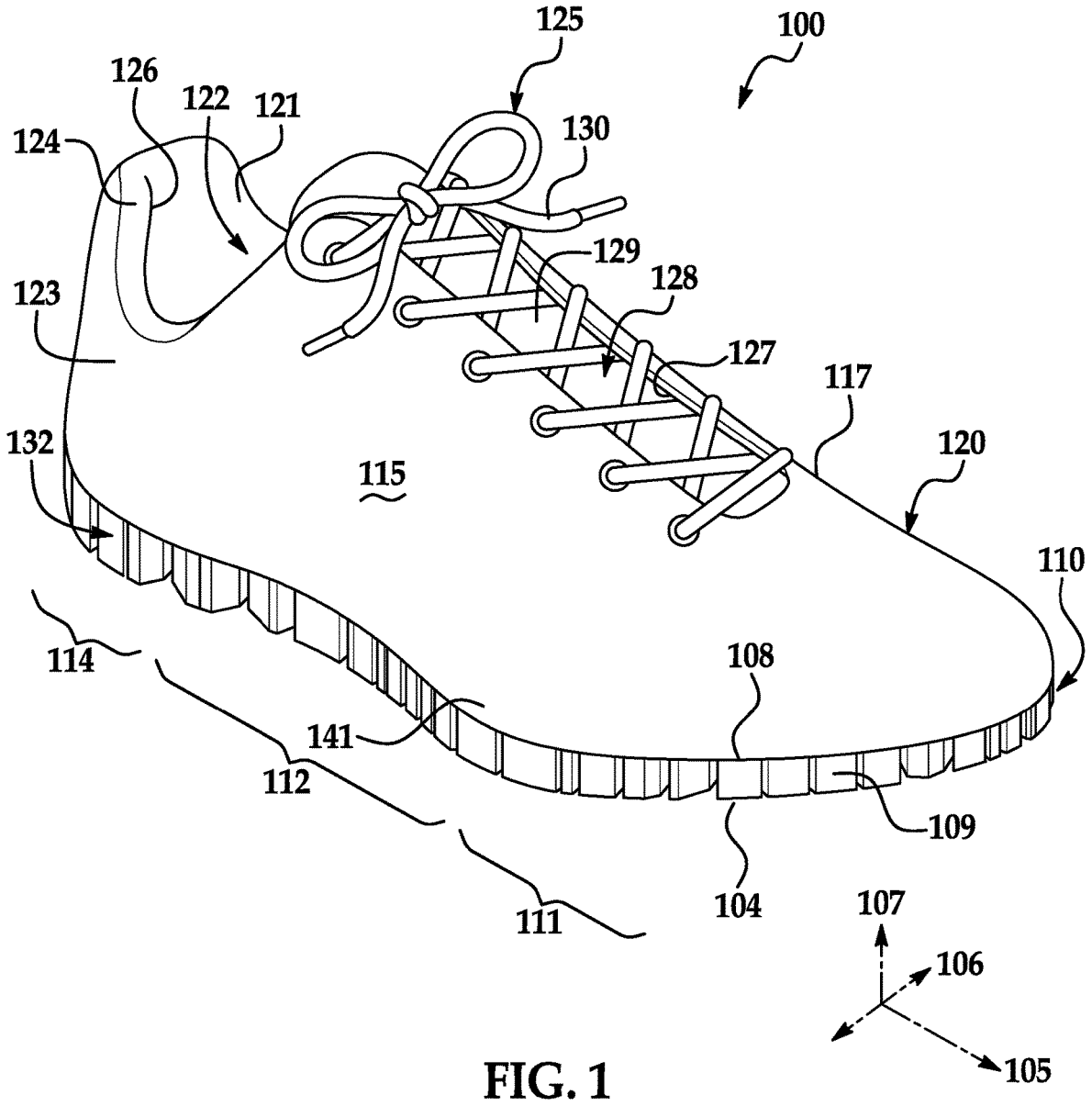
FIG. 1 is an isometric view of an article of footwear according to exemplary embodiments of the present disclosure.

In one aspect, the present disclosure relates to an article of footwear that includes an upper that defines a cavity configured to receive a foot. The footwear also includes a sole structure that is attached to the upper. The sole structure includes an auxetic structure and a filler. The auxetic structure includes an aperture. The filler is received in the aperture. The auxetic structure is configured to deform auxetically. The sole structure is configured to deform between a neutral position and a deformed position. The aperture is configured to deform as the sole structure deforms between the neutral and deformed positions. The auxetic structure includes a first material, and the filler includes a second material, which is softer than the first material to facilitate the auxetic deformation of the sole structure. The article of footwear may be tuned using auxetic structures. With the auxetic structures, the ride, fit, and cushioning across the sole structure can be customized. Such customization is generally not possible when using a monolithic rubber or foam sole. The heel region is configured to absorb energy, while providing lateral stability. The midfoot region can be stiffer than the heel region and/or non-auxetic, because the foot exerts very little contact pressure at the midfoot portion when compared with the heel region. The forefoot region has enough firmness and structure to enable a good/firm push-off without needing to dig out of a mushy cushion.

According to one or more aspects, the first and second materials differ in at least one mechanical property, and the differing mechanical property of the first and second materials may be density, firmness, hardness, elasticity, resiliency, and/or a combination thereof.

In one or more aspects, the aperture is configured to contract as the sole structure deforms between the neutral position and the deformed position. The filler may be configured (i.e., constructed and designed) to increase in density as the aperture contracts.

In one or more aspects, the sole structure defines a ground-facing surface. Further, the sole structure defines a thickness direction that extends generally from the ground-facing surface toward the upper. The sole structure is configured to compress in the thickness direction as the sole structure deforms from the neutral position toward the deformed position. The aperture is configured to contract as the sole structure deforms from the neutral position toward the deformed position. The filler is configured to increase in density as the aperture contracts.

In one or more aspects, the filler is attached to the auxetic structure. The aperture is configured to expand as the sole structure deforms between the neutral position and the deformed position.

In one or more aspects, the first material of the auxetic structure is a first foam, and the second material of the filler is a second foam.

In one or more aspects, the first foam has a hardness between approximately fifty to sixty-five (50-65) Asker C Hardness. The second foam has a hardness between approximately thirty to forty-five (30-45) Asker C Hardness.

In one or more aspects, the filler is attached to the auxetic structure.

In one or more aspects, the filler and the auxetic structure are chemically bonded together.

In one or more aspects, the aperture has a volume, and wherein the filler occupies a majority of the volume of the aperture.

In one or more aspects, the sole structure includes a ground-facing surface and a top surface that faces opposite the ground-facing surface. The auxetic structure includes an inner wall that at least partially defines the aperture. The aperture includes a first end and a second end. The inner wall extends in a thickness direction between the first end and the second end, wherein the first end is closer to the ground-facing surface than to the top surface. The second end is closer to the top surface than to the ground-facing surface. The filler includes an upper end and a lower end. The upper end is closer to the second end of the aperture than to the first end of the aperture, and the lower end is spaced apart at a distance from the first end of the aperture.

In one or more aspects, the distance from the first end of the aperture to the lower end of the filler partly defines a space within the aperture. The space is defined between the lower end of the filler and the first end of the aperture. The sole structure further includes a plug. The plug is disposed within the space between the lower end of the filler and the first end of the aperture.

In one or more aspects, the sole structure further comprises a pad, the pad is disposed outside the aperture, and the pad is attached to the filler.

In one or more aspects, the pad and the filler are integrally attached to define a unitary, one-piece support body.

In one or more aspects, the auxetic structure is at least partially embedded within the unitary, one-piece support body.

In one or more aspects, the auxetic structure includes an inner wall that at least partially defines the aperture. The aperture includes a first end and a second end. The inner wall extends in a thickness direction between the first end and the second end. The aperture has a width that is measured between opposing areas of the inner wall. The width varies in the thickness direction from the first end to the second end.

In one or more aspects, the sole structure includes a ground-facing surface and a top surface that faces opposite the ground-facing surface. The first end is closer to the ground-facing surface than to the top surface, and the second end is closer to the top surface than to the ground-facing surface. The width of the aperture tapers in the thickness direction from the first end to the second end.

In one or more aspects, the width of the aperture proximate the first end is less than the width of the aperture proximate the second end.

In another aspect, the present disclosure relates to an article of footwear that includes an upper that defines a cavity configured to receive a foot. The footwear also includes a sole structure that is attached to the upper. The sole structure includes an auxetic structure and a filler. The auxetic structure includes an aperture. The filler is received in the aperture, and the auxetic structure is configured to deform auxetically. The sole structure is configured to deform between a neutral position and a second position. The aperture is configured to deform as the sole structure deforms between the neutral and positions. The filler includes a first foam material, and the auxetic structure includes a second foam material. The second foam material has a hardness between approximately fifty to sixty-five (50-65) Asker C Hardness. The first foam material has a hardness between approximately thirty to forty-five (30-45) Asker C Hardness. The filler is configured to change in density as the sole structure deforms between the neutral and deformed positions.

In one or more aspects, the sole structure is configured to compress in a thickness direction. The aperture is configured to contract in a horizontal direction as the sole structure compresses. The filler is configured to increase in density as the aperture contracts.

In one or more aspects, the foam material of the filler is a first foam material. The auxetic structure includes a second foam material. The first and second foam materials differ in at least one mechanical property, which may be density, firmness, hardness, elasticity, resiliency, and/or a combination thereof.

In one or more aspects, the second foam material has a hardness between approximately fifty to sixty-five (50-65) Asker C Hardness. The first foam material has a hardness between approximately thirty to forty-five (30-45) Asker C Hardness.

In one or more aspects, the filler is attached to the auxetic structure.

In one or more aspects, the filler and the auxetic structure are chemically bonded together.

In one or more aspects, the aperture has a volume, and wherein the filler occupies a majority of the volume of the aperture.

In one or more aspects, the sole structure includes a ground-facing surface and a top surface that faces opposite the ground-facing surface. The auxetic structure includes an inner wall that at least partially defines the aperture. The aperture includes a first end and a second end. The inner wall extends in a thickness direction from the first end toward the second end, the first end is closer to the ground-facing surface than to top surface, and wherein the second end is closer to the top surface than to the ground-facing surface; and In one or more aspects, the filler includes an upper end and a lower end, the upper end is closer to the second end than to the first end of the aperture, and the lower end is spaced apart at a distance from the first end of the aperture.

In one or more aspects, the distance from the first end of the aperture to the lower end of the filler partly defines a space within the aperture, the space defined between the lower end of the filler and the first end of the aperture. The sole structure further includes a plug. The plug is disposed within the space between the lower end of the filler and the first end of the aperture.

In one or more aspects, the sole structure further comprises a pad. The pad is disposed outside the aperture, and the pad is attached to the filler.

In one or more aspects, the pad and the filler are integrally attached to define a unitary, one-piece support body.

In one or more aspects, the auxetic structure is at least partially embedded within the unitary, one-piece support body.

In one or more aspects, the auxetic structure includes an inner wall that at least partially defines the aperture. The aperture includes a first end and a second end. The inner wall extends in a thickness direction from the first end toward the second end. The aperture has a width that is measured between opposing areas of the inner wall. The width varies in the thickness direction from the first end to the second end.

In one or more aspects, the sole structure includes a ground-facing surface and a top surface that faces opposite the ground-facing surface. The first end of the aperture is closer to the ground-facing surface than to the top surface, and the second end of the aperture is closer to the top surface than to the ground-facing surface. The width of the aperture tapers in the thickness direction from the first end toward the second end. The width of the aperture at the first end is less than the width of the aperture at the second end. The sole structure is configured to compress in a thickness direction. The aperture is configured to contract in a horizontal direction as the sole structure compresses. The filler is configured to compact toward the first end and increase in density as the aperture contracts.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

The following relates to an article of footwear with a sole structure that is highly deformable. As such, the sole structure can deform to accommodate movements of the foot, to absorb forces, and the like. The sole structure can also be resilient to provide cushioning and/or energy return to the wearer's foot.

In some embodiments, the sole structure can have auxetic characteristics. This can enhance the flexibility, stretchability or other types of deformation of the sole structure. Moreover, the sole structure can include one or more features that enhance support for the wearer's foot. Accordingly, the article of footwear can be highly comfortable for the wearer.

Referring initially to FIG. 1, an article of footwear 100 is illustrated according to exemplary embodiments. Generally, the footwear 100 can include a sole structure 110 and an upper 120. The upper 120 is attached (or otherwise coupled) to the sole structure 110. The upper 120 can receive the wearer's foot and secure the footwear 100 to the wearer's foot whereas the sole structure 110 can extend underneath the upper 120 and support the wearer.

For reference purposes, the footwear 100 may be divided into three general regions: a forefoot region 111, a midfoot region 112, and a heel region 114. The forefoot region 111 can generally include areas of the footwear 100 that correspond with forward portions of the wearer's foot, including the toes and joints connecting the metatarsals with the phalanges. The midfoot region 112 can generally include areas of the footwear 100 that correspond with middle portions of the wearer's foot, including an arch area. The heel region 114 can generally include areas of the footwear 100 that correspond with rear portions of the wearer's foot, including the heel and calcaneus bone. The footwear 100 can also include a lateral side 115 and a medial side 117. The lateral side 115 and the medial side 117 can extend through the forefoot region 111, the midfoot region 112, and the heel region 114 in some embodiments. The lateral side 115 and the medial side 117 can correspond with opposite sides of footwear 100. More particularly, the lateral side 115 can correspond with an outside area of the wearer's foot (i.e. the surface that faces away from the other foot), and the medial side 117 can correspond with an inside area of the wearer's foot (i.e., the surface that faces toward the other foot). The forefoot region 111, midfoot region 112, heel region 114, lateral side 115, and medial side 117 are not intended to demarcate precise areas of footwear 100. Rather, the forefoot region 111, midfoot region 112, heel region 114, lateral side 115, and medial side 117 are intended to represent general areas of footwear 100 to aid in the following discussion.

The footwear 100 can also extend along various directions. For example, as shown in FIG. 1, the footwear 100 can extend along a longitudinal direction 105, a transverse direction 106, and a vertical direction 107. The longitudinal direction 105 can extend generally between the heel region 114 and the forefoot region 111. The transverse direction 106 can extend generally between the lateral side 115 and the medial side 117. Also, the vertical direction 107 can extend generally between the upper 120 and the sole structure 110. It will be appreciated that the longitudinal direction 105, transverse direction 106, and vertical direction 107 are indicated for reference purposes and to aid in the following discussion. The terms "horizontal", "horizontal direction", and other related terms will be used herein and will be understood to correspond with the longitudinal direction 105 and/or the transverse direction 106. Thus, for example, deformation of the sole structure 110 in the "horizontal direction" can be deformation of the sole structure 110 along the longitudinal direction 105 and/or the transverse direction 106.

Embodiments of the upper 120 will now be discussed generally with reference to FIG. 1. As shown, the upper 120 can define a cavity 122 configured (e.g., shaped and sized) to receive a foot of the wearer. The upper 120 can have an interior surface 121 that defines the cavity 122. The upper 120 can also include an exterior surface 123 that faces opposite the interior surface 121. When the wearer's foot is received within the cavity 122, the upper 120 can at least partially enclose and encapsulate the wearer's foot. Thus, the upper 120 can extend about the forefoot region 111, lateral side 115, heel region 114, and medial side 117 in some embodiments. Also, in some embodiments, the upper 120 can span at least partly underneath the wearer's foot.

The upper 120 can also include a collar 124. The collar 124 can include a collar opening 126 that is configured to allow passage of the wearer's foot into and out of the cavity 122.

Furthermore, the upper 120 can include a throat 128. The throat 128 can extend from the collar opening 126 toward the forefoot region 111. In some embodiments, such as the embodiment of FIG. 1, the throat 128 can include a throat opening 127 between the lateral side 115 and the medial side 117. In other embodiments, the throat 128 can be "closed," such that the upper 120 is more sock-like and is substantially continuous and uninterrupted between the lateral side 115 and the medial side 117.

Additionally, the upper 120 can include a closure device 125. In some embodiments, the closure device 125 can be a shoelace 130 that extends between the lateral side 115 and the medial side 117. In other embodiments, the closure device 125 can include a strap, a cable, a buckle, a hook, or other type. By pulling on the closure device 125, the lateral side 115 and the medial side 117 can be drawn toward each other. By loosening the closure device 125, the lateral side 115 and the medial side 117 can move away from each other. Thus, the closure device 125 can be used to adjust the fit of the article of footwear 100.

Moreover, in some embodiments, the footwear 100 can include a tongue 129 within the throat opening 127. The tongue 129 can be attached to an adjacent area of the upper 120, for example, proximate the forefoot region 111. The tongue 129 can also be detached from the lateral side 115 and/or the medial side 117 in some embodiments. The tongue 129 can be disposed between the shoelace 130 and the wearer's foot.

Embodiments of the sole structure 110 will now be discussed generally with reference to FIG. 1. The sole structure 110 can be secured to the upper 120 and can extend between the wearer's foot and the ground when the footwear 100 is worn. Also, the sole structure 110 can include a ground-facing surface 104. The ground-facing surface 104 may a ground-contacting surface. Furthermore, the sole structure 110 can include an upper surface 108 that faces the upper 120. Stated differently, the upper surface 108 can face in an opposite direction from the ground-facing surface 104. The upper surface 108 can be attached to the upper 120. Also, the sole structure 110 can include a side peripheral surface 109 that extends along the vertical direction 107 between the ground-facing surface 104 and the upper surface 108. In some embodiments, the side peripheral surface 109 can also extend substantially continuously about footwear 100 between the forefoot region 111, the lateral side 115, the heel region 114, the medial side 117, and back to the forefoot region 111.

In some embodiments, the sole structure 110 can include one or more features that allow it to deform auxetically. As such, the sole structure 110 can be referred to as an auxetic member. The sole structure 110 can also be characterized as having a negative Poisson's ratio. This means that, for example, when the sole structure 110 is stretched in a first direction, the sole structure 110 can elongate in a direction that is orthogonal to the first direction. Specifically, when the sole structure 110 is under tension along the longitudinal direction 105, the sole structure 110 can increase in width along the transverse direction 106. Also, when the sole structure 110 is stretched wider along the transverse direction 106, the sole structure 110 can elongate along the longitudinal direction 105. Moreover, if the sole structure 110 contracts in the transverse direction 106, the sole structure 110 can shorten along the longitudinal direction 105. Also, if the sole structure 110 contracts in the longitudinal direction 105, the sole structure 110 can become narrower along the transverse direction 106.

The sole structure 110 can include one or more features disclosed in U.S. patent application Ser. No. 14/030,002, filed Sep. 18, 2013, published as U.S. Patent Publication Number 2015/0075033, and entitled "Auxetic Structures and Footwear with Soles Having Auxetic Structures", the entire disclosure of which is hereby incorporated by reference.

Figure 2:
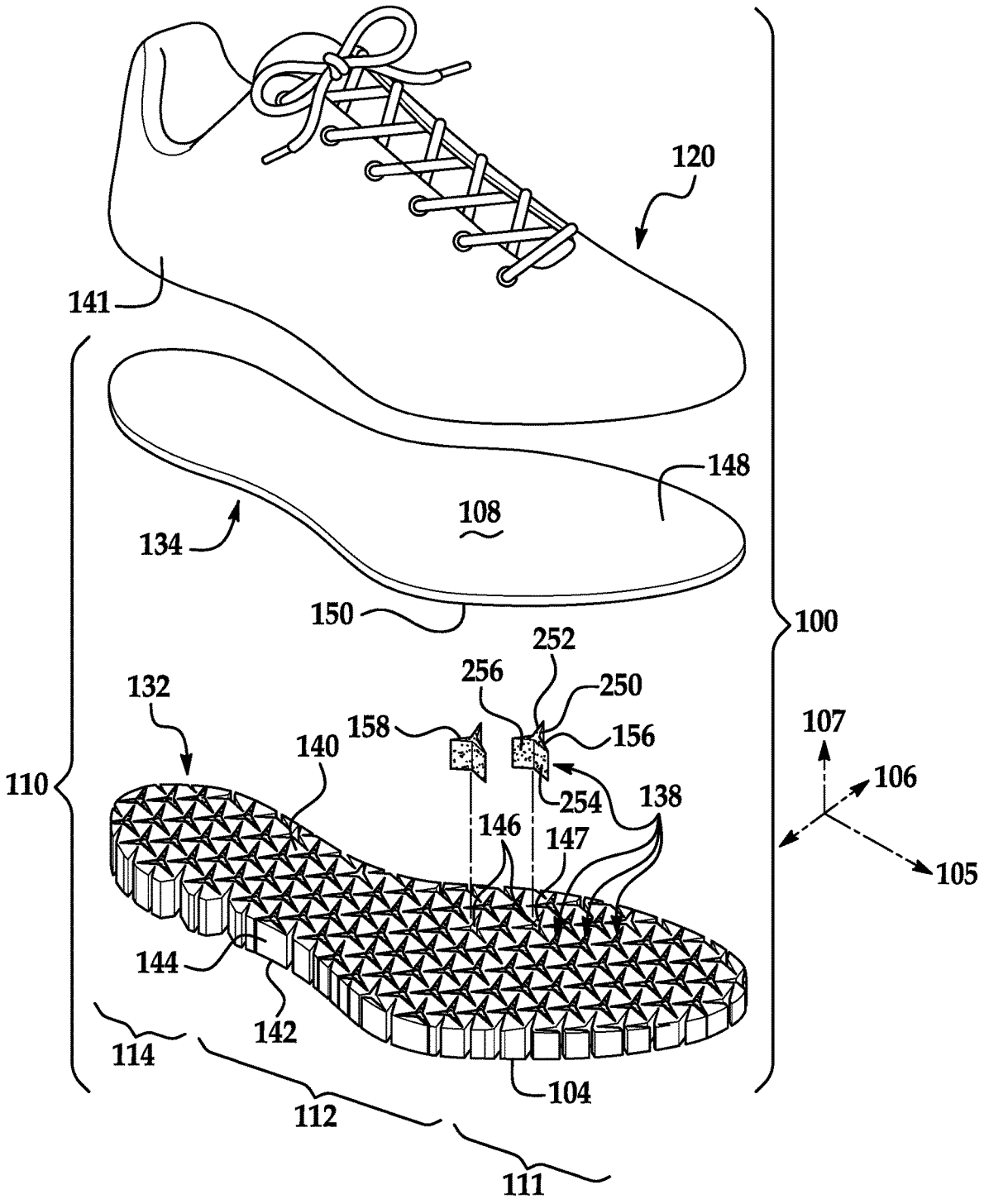
FIG. 2 is an exploded isometric view of the article of footwear of FIG. 1.

As shown in the exploded view of FIG. 2, the sole structure 110 can include a number of components. More specifically, as shown in the exemplary embodiment of FIG. 2, the sole structure 110 can include an auxetic structure 132, a pad 134, and one or more fillers 138. In FIG. 2, two exemplary fillers 138, identified as a first filler 156 and a second filler 158, are shown exploded from the auxetic structure 132. The remaining fillers 138 are shown received by the auxetic structure 132 in FIG. 2. The fillers 138 may be wholly or partly made of a foam material as described, for example, in U.S. Pat. No. 7,941,938, which patent is entirely incorporated herein by reference. This foam material may have a lightweight, spongy feel. The density of the foam material may be generally less than 0.25 g/cm3, less than 0.20 g/cm3, less than 18 g/cm3, less than 0.15 g/cm3, less than 0.12 g/cm3, and in some examples, about 0.10 g/cm3. As example ranges, the foam density may fall within the range, for example, of 0.05 to 0.25 g/cm3 or within the various ranges noted above. The resiliency of the foam material for the fillers 138 may be greater than 40%, greater than 45%, at least 50%, and in one aspect from 50-70%. Compression set may be 60% or less, 50% or less, 45% or less, and in some instances, within the range of 20 to 60%. The hardness (Durometer Asker C) of the foam material for the fillers 138 may be, for example, 25 to 50, 25 to 45, 25 to 35, or 35 to 45, e.g., depending on the type of footwear. The tensile strength of the foam material may be at least 15 kg/cm2, and typically 15 to 40 kg/cm2. The elongation % is 150 to 500, typically above 250. The tear strength is 6-15 kg/cm, typically above 7. The foam material for the fillers 138 may have lower energy loss and may be more lightweight than traditional EVA foams. As additional examples, if desired, at least some portion of the fillers 138 may be made from foam materials used in the LUNAR family of footwear products available from NIKE, Inc. of Beaverton, Oreg. The properties (including ranges) of the foam material for the fillers 138 described in this paragraph allow the fillers 138 to enhance the support provided by the sole structure 100 to the wearer's foot without compromising the auxetic properties of the auxetic structure 132.

It will be appreciated that the sole structure 110 can include more or fewer components than the ones illustrated in FIG. 2 without departing from the scope of the present disclosure. Additionally, in some embodiments, these components can be removably attached to each other. In other embodiments, two or more of these components can be integrally attached to define a unitary, one-piece component. As non-limiting example, each filler 138 may be a discrete component and, therefore, the fillers 138 can be coupled to the each other only through the auxetic structure 132. It is envisioned that the fillers 138 may only be directly coupled to the auxetic structure 132 and the pad 134.

The auxetic structure 132 can include an upper surface 140, which faces the upper 120 of the footwear 100. The auxetic structure 132 can also include a lower surface 142, which faces opposite the upper surface 140. Furthermore, the auxetic structure 132 can include an outer periphery 144, which extends between the upper surface 140 and the lower surface 142 on the periphery of the auxetic structure 132. The auxetic structure 132 can additionally include a plurality of apertures 146. In some embodiments, the apertures 146 can be through-holes that extend through the auxetic structure 132 in the vertical direction 107 (i.e., the thickness direction of the sole structure 110). Also, the apertures 146 can be open at the upper surface 140 and/or the lower surface 142. In other embodiments, the apertures 146 can be pockets or recesses. For example, the apertures 146 can be recessed downward from the upper surface 140 such that the apertures 146 include a closed bottom end. Alternatively, the apertures 146 can be recessed upward from the lower surface 142 such that the apertures 146 include a closed upper end. In additional embodiments, the apertures 146 can be internal cells within the auxetic structure 132 that are closed off at the upper surface 140 and the lower surface 142.

In some embodiments, the auxetic structure 132 can be made from and/or include resilient, elastic material, such as foam, rubber, or another polymeric material. The auxetic structure 132 can be compressible in the vertical direction 107 and can attenuate impact and other loads. Also, in some embodiments, the auxetic structure 132 can be made from and/or include a high-friction material. As such, the auxetic structure 132 can at least partially define an outsole of the sole structure 110. Furthermore, in some embodiments, the lower surface 142 can at least partially define the ground-facing surface 104 of the sole structure 110, and as such, the lower surface 142 can include the high-friction material for enhancing traction.

As shown in FIG. 2, the pad 134 can be a relatively thin member that includes a top surface 148 and an opposing bottom surface 150. The top surface 148 can be attached to the upper 120 of the article of footwear 100. Thus, the top surface 148 can at least partially define the upper surface 108 of the sole structure 110. The pad 134 can also span between the forefoot region 111, the midfoot region 112, the heel region 114, the lateral side 115, and the medial side 117 of the sole structure 110 in some embodiments. Additionally, in some embodiments, a lower edge 141 of the upper 120 can be attached to the top surface 148 of the pad 134. Furthermore, in some embodiments, the upper 120 can include a strobel, strobel-sock, or other underfoot member that is layered on and attached to the top surface 148 of the pad 134. The bottom surface 150 of the pad 134 can be layered on the upper surface 140 of the auxetic structure 132. In some embodiments, the pad 134 can cover over and/or close off one or more of the apertures 146 of the auxetic structure 132. However, the pad 134 can be disposed outside the apertures 146 in some embodiments. Furthermore, in some embodiments, the pad 134 can be attached to the auxetic structure 132. For example, the pad 134 and the auxetic structure 132 can be attached via adhesives. In additional embodiments, the pad 134 and the auxetic structure 132 can be chemically bonded. As such, there may not be a defined boundary between the bottom surface 150 of the pad 134 and the upper surface 140 of the auxetic structure 132; rather, atoms of the pad 134 can be bonded (e.g., ionic bonds, covalent bonds, etc.) with the atoms of the auxetic structure 132 to achieve the chemical attachment between the pad 134 and the auxetic structure 132.

In some embodiments, the pad 134 of the sole structure 110 can be elastic and resilient. For example, the pad 134 can be elastically stretchable in the longitudinal direction 105 and the transverse direction 106. As such, the pad 134 can deform at the same time as the auxetic structure 132 as will be discussed. Also, the pad 134 can be formed from and/or include resiliently compressible material. The pad 134 can be compressible elastically in the vertical direction 107. In some embodiments, the material of the pad 134 can be different from the material of the auxetic structure 132. For example, in some embodiments, the material of the auxetic structure 132 can be firmer, harder, denser, and/or stiffer than the material of the pad 134. Accordingly, the pad 134 can attenuate forces, can provide cushioning, and can provide energy return to the wearer's foot. Moreover, in some embodiments, the pad 134 can at least partially define a midsole for the sole structure 110.

Figure 3:
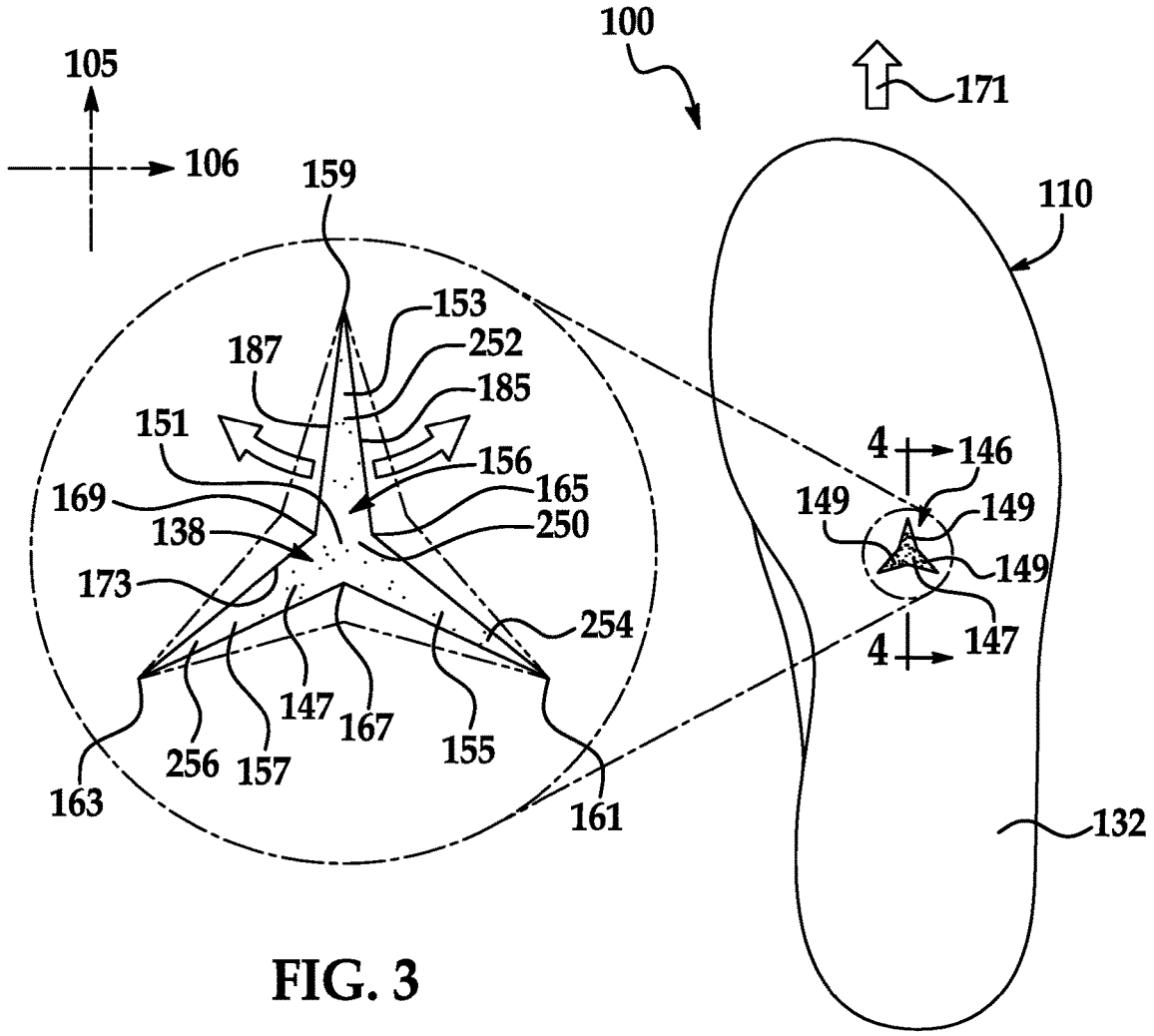
FIG. 3 is a bottom schematic view of a sole structure of the article of footwear of FIG. 1.
Figure 4:
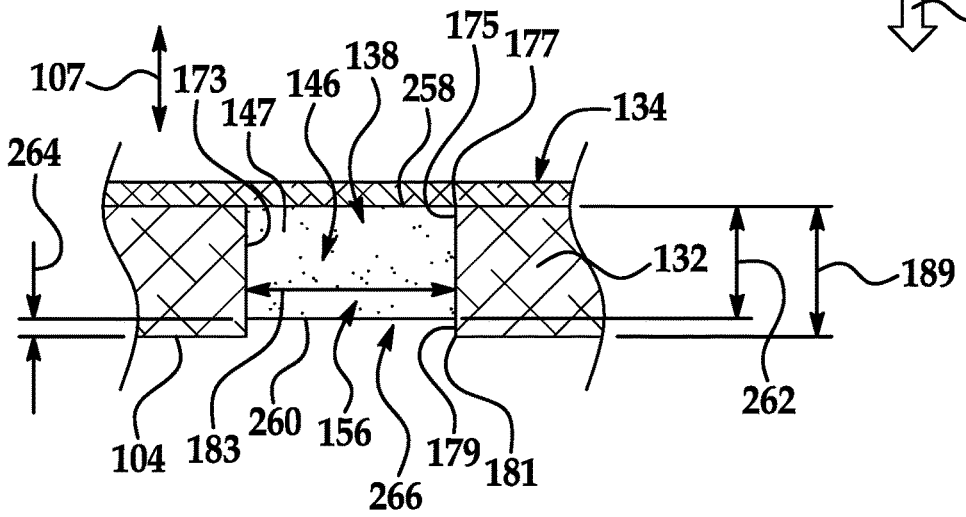
FIG. 4 is a cross section of a sole structure of the article of footwear taken along the line 4-4 of FIG. 3.

Referring now to FIGS. 2-4, the apertures 146 of the auxetic structure 132 will be discussed in greater detail according to exemplary embodiments. As seen in FIG. 2, the auxetic structure 132 can include apertures 146 disposed within the forefoot region 111, the midfoot region 112, and the heel region 114. In other embodiments, the apertures 146 may be included in only some of these regions.

The apertures 146 can have any suitable geometry and configuration, and the apertures 146 can be disposed in any suitable arrangement in the sole structure 110. The apertures 146 can be shaped such that, when the sole structure 110 is stretched, the apertures 146 deform, allowing for auxetic deformation of the sole structure 110.

An exemplary aperture 146 is shown in detail in FIGS. 3 and 4. The aperture 146 shown in FIG. 3 can be representative of the other apertures of the sole structure 110. As shown in FIG. 3, the aperture 146 can include a plurality of arms 149 that project from a common center 151. The arms 149 can include a first arm 153, a second arm 155, and a third arm 157. The first arm 153 can include a first end 159 that is pointed. Similarly, the second arm 155 can include a second end 161, and the third arm 157 can include a third end 163. The first arm 153 and the second arm 155 can be joined at a first junction 165. The second arm 155 and the third arm 157 can be joined at a second junction 167. The third arm 157 and the first arm 153 can be joined at a third junction 169. With this configuration, the aperture 146 can be referred to as having a so-called "tri-star geometry". In other embodiments, one or more apertures 146 can have other geometries, such as parallelogram-shaped geometries or other polygonal geometries that provide the sole structure 110 with auxetic properties.

Also, an embodiment of the aperture 146 is shown in FIG. 4 in cross section along the vertical direction 107 (i.e., in the thickness direction through the thickness of the sole structure 110). As shown, the aperture 146 can have a top end 175 that is defined by a top rim 177 and a bottom end 179 that is defined by a bottom rim 181. The aperture 146 can also include an inner wall 173 that extends in the vertical direction 107, between the top end 175 and the bottom end 179. The inner wall 173 can at least partly define the periphery of the aperture 146. As shown, the pad 134 can extend across the top rim 177 and close off the top end 175 of the aperture 146.

In some embodiments, the aperture 146 can have a width 183, which is measured between opposing areas of the inner wall 173 as shown in FIG. 4. In the embodiment of FIGS. 3 and 4, the width 183 is indicated between end 159 and the junction 167, which oppose each other in the longitudinal direction 105. However, it will be appreciated that the width of the aperture 146 can be measured between other opposing areas of the aperture 146, such as between the first junction 165 and the third junction 169.

The aperture 146 can additionally have a height 189, which is indicated in FIG. 4. The height 189 can be measured in the vertical direction 107, from the top end 175 to the bottom end 179. In some embodiments, the height 189 can be measured from the top rim 177 to the bottom rim 181.

As shown in FIG. 4, the width 183 of the aperture 146 can be substantially constant along the height 189 of the aperture 146. Stated differently, the width 183 can be substantially the same at the top rim 177 as at the bottom rim 181 and at intermediate locations along the inner wall 173. In other embodiments, the width 183 can vary between the top end 175 and the bottom end 179. For example, in some embodiments, the inner wall 173 can taper with respect to the vertical direction 107. More specifically, the inner wall 173 can taper along the vertical direction 107 such that the width 183 is greater proximate the top end 175 than at the bottom end 179. It will be appreciated that the apertures 146 can be shaped differently from the illustrated embodiments without departing from the scope of the present disclosure.

Additionally, the aperture 146 can have a volume. The volume can be calculated by taking the area of the aperture 146 measured in the horizontal direction (i.e., in the longitudinal direction 105 and the transverse direction 106) and multiplying the area by the height 189. The volume of the aperture 146 can change as the sole structure 110 deforms.

Deformation of the sole structure 110 will now be discussed according to exemplary embodiments. Deformation of the sole structure 110 can occur coincidentally with deformation of the apertures 146. Deformation of the apertures 146 will be discussed specifically with regard to a representative aperture 147, which is indicated in FIGS. 2 and 3. This deformation can be a result of a stretching load directed along the longitudinal direction 105, as indicated by arrows 171 in FIG. 3. A neutral, undeformed position of the aperture 147 is shown in solid lines in FIG. 3. An expanded, deformed position of the aperture 147 is shown in broken lines in FIG. 3 according to exemplary embodiments.

As shown, the inner wall 173 of the aperture 147 can flex as the aperture 147 expands to the deformed position. For example, a first segment 185 and a second segment 187 of the inner wall 173 can rotate away from each other about the first end 159 as the aperture 147 deforms to the deformed position. Thus, the first end 159 can act similar to a hinge. Other segments of the inner wall 173 can flex similarly with the second end 161, third end 163, first junction 165, second junction 167, and/or third junction 169 also acting as hinges. The first end 159 and the second junction 167 can also move further apart from each other along the longitudinal direction 105 as the aperture 147 deforms to the deformed position. As a result, the aperture 147 can expand in both the longitudinal direction 105 and the transverse direction 106, and the volume of the aperture 147 can increase as the sole structure 110 flexes.

The elasticity and resiliency of the sole structure 110 can cause the aperture 147 to contract and recover to its neutral position once the stretching loads 171 are reduced. For example, the first segment 185 and the second segment 187 can rotate toward each other about the first end 159 as the aperture 147 recovers to the neutral position. Other segments of the inner wall 173 of the aperture 147 can rotate similarly as the sole structure 110 recovers to its neutral position.

Figure 5:
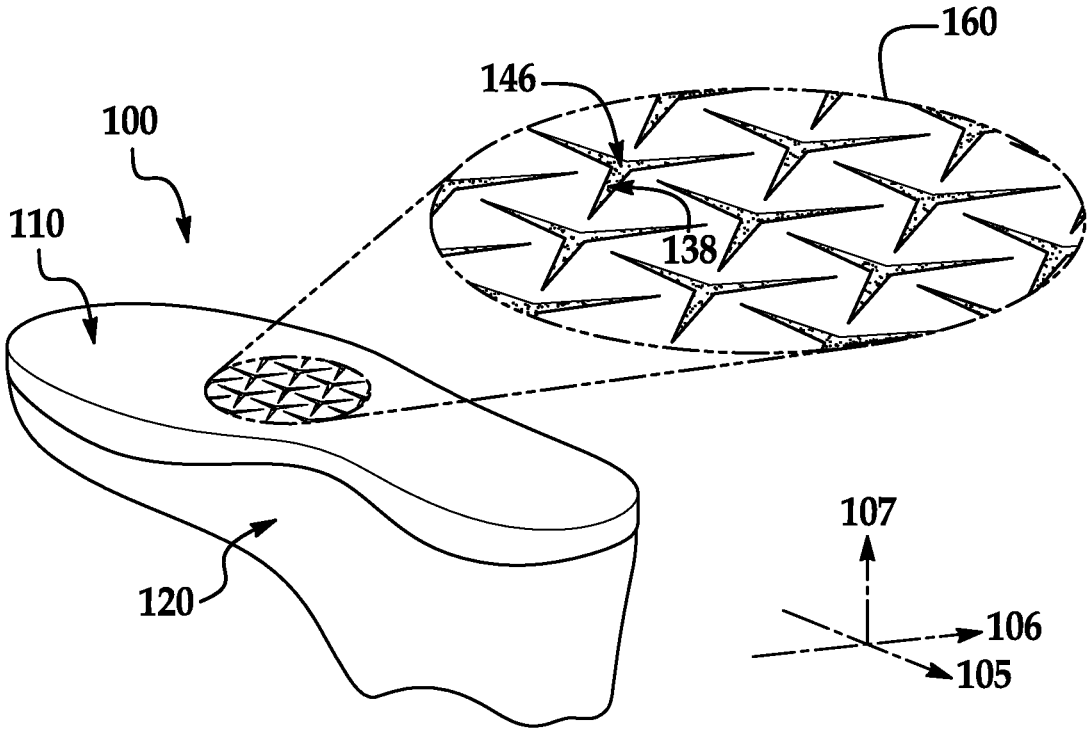
FIG. 5 is an isometric view of the article of footwear of FIG. 1, wherein the sole structure is shown in a neutral position or state.
Figure 6:
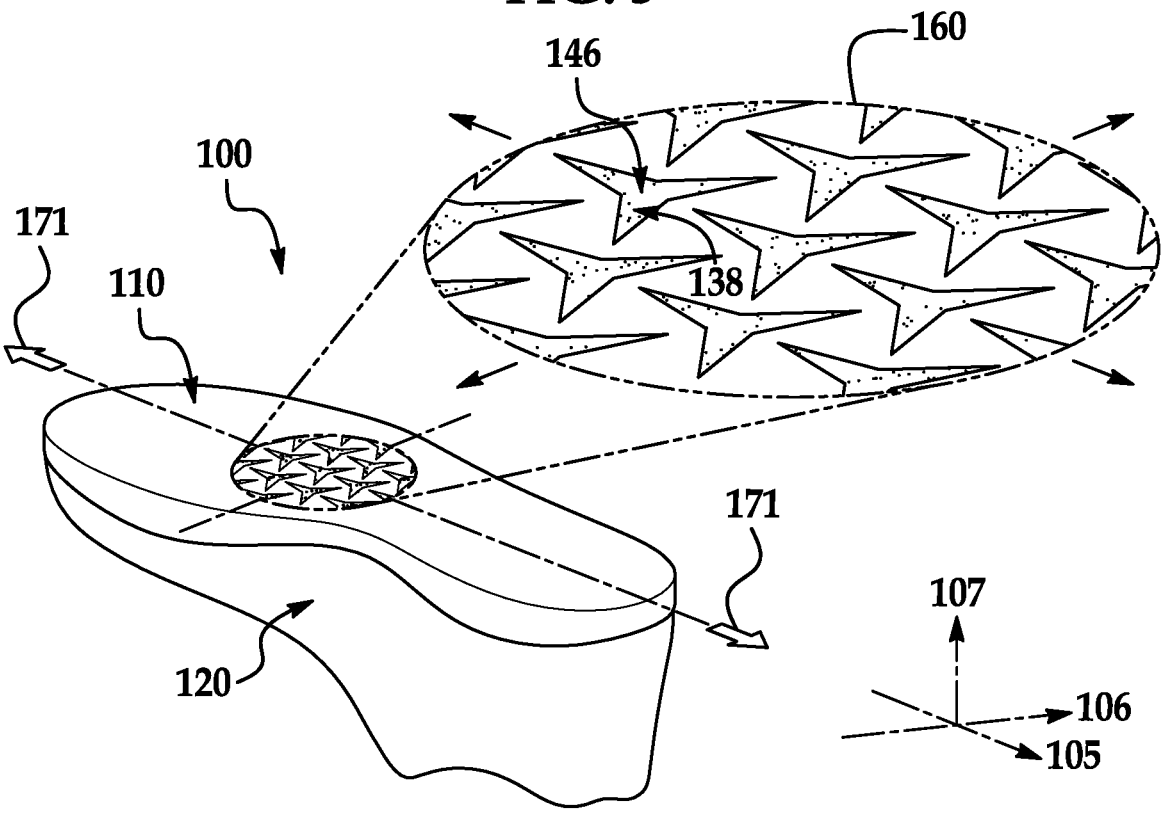
FIG. 6 is an isometric view of the article of footwear of FIG. 1, wherein the sole structure is shown in a deformed position.

Multiple apertures 146 of the sole structure 110 can deform in the manner illustrated in FIG. 3. Also, the apertures 146 can be arranged on the sole structure 110 in a predetermined pattern that enhances the auxetic deformation of the sole structure 110. An example of the auxetic expansion is shown in FIGS. 5 and 6. For purposes of illustration, only a region 160 of the sole structure 110 is shown in detail, where region 160 includes a subset of the apertures 146. Specifically, FIG. 5 can represent the neutral, unloaded position (i.e., the first position) of the sole structure 110, and FIG. 6 can represent the stretched, deformed position (i.e., the second position) of the sole structure 110. Accordingly, the sole structure 110 is configured to move (e.g., deform) between the neutral, unloaded position (i.e., the first position) and the stretched, deformed position (i.e., the second position).

As tension is applied across the sole structure 110 along an exemplary direction (e.g., along the longitudinal direction 105 as represented by arrows 171 in FIG. 6), the sole structure 110 can undergo auxetic expansion. That is, the sole structure 110 can expand along the longitudinal direction 105, as well as in the transverse direction 106. In FIG. 6, the representative region 160 is seen to expand in both the longitudinal direction 105 and the transverse direction 106 simultaneously as the apertures 146 expand. Thus, the sole structure 110 can expand as a result of a stretching load, which is indicated by the arrows 171 in FIG. 6.

This type of expansion and stretching can occur, for example, when the wearer pushes off the ground, track, or other supporting surface. The stretching and expansion can also occur when the wearer changes directions, pivots, cuts, or jumps. It can also result from movement of the wearer's foot within the footwear 100.

It will be appreciated that the sole structure 110 can also contract as a result of an applied load. For example, if the direction of the applied load represented by arrows 171 is reversed, then the sole structure 110 can contract in the longitudinal direction 105 and the transverse direction 106 (e.g., in an opposite manner to the one depicted in FIG. 3). Specifically, the length of the sole structure 110 can reduce along the longitudinal direction 105, and the width of the sole structure 110 can reduce along the transverse direction 106. Also, the apertures 146 can contract and the volume of the apertures 146 can reduce (e.g., in an opposite manner to the one depicted in FIG. 6). As a result, the sole structure 110 can contract auxetically from the neutral position (i.e., a first position) to a contracted, deformed position (i.e. a second position). Also, the resiliency of the sole structure 110 can cause the sole structure 110 to recover back to its neutral position once the loads are reduced.

Furthermore, the sole structure 110 can be compressible along the vertical direction 107 (i.e., the thickness direction of the sole structure 110). The weight of the wearer, impact with the ground, etc. can cause this compression of the sole structure 110. Compression loads can cause the apertures 146 to deform. In some embodiments, compression of the sole structure 110 can cause the apertures 146 to contract in the horizontal direction (i.e., in the longitudinal direction 105 and/or the transverse direction 106). In additional embodiments, the apertures 146 can expand as the sole structure 110 is compressed as will be discussed.

The highly deformable sole structure 110 can provide the foot with a high range of movement, especially compared to conventional sole structures. Thus, movement of the foot is less likely to be bound or limited by the article of footwear 100. In some situations, the sole structure 110 can provide the wearer with the feeling of being barefoot or nearly barefoot.

It will be appreciated that the increased flexibility of the sole structure 110 can affect the cushioning, energy return, or other types of support that the sole structure 110 provides to the wearer's foot. For example, the auxetic structure 132 alone may be too compressible to provide adequate support in some cases due to the plurality of apertures 146. Thus, the sole structure 110 can include one or more additional features that enhance the support that the sole structure 110 provides to the wearer's foot.

More specifically, as shown in FIGS. 2-7, the sole structure 110 may include a lower member 136 between the auxetic structure 132 and the upper 120. The lower member 136 can be a sheet-like member that includes a top surface 152 and an opposing bottom surface 154. The top surface 152 can be layered on and attached to the lower surface 142 of the auxetic structure 132. As such, the lower member 136 can close off the lower ends of the apertures 146 of the auxetic structure 132. The bottom surface 154 can define the ground-facing surface 104 of the sole structure 110.

The lower member 136 can be made from a high-friction material for enhancing traction of the sole structure 110. Also, the lower member 136 can be elastically stretchable in the longitudinal direction 105 and the transverse direction 106. As such, the lower member 136 can deform in concert with the auxetic structure 132.

Further, the sole structure 110 can include at least one of the fillers 138 for these purposes. The fillers 138 can be received in respective apertures 146 and can provide needed support at these otherwise empty areas of the sole structure 110. Accordingly, the combination of the auxetic structure 132 and the fillers 138 can allow the sole structure 110 to be highly flexible and, yet, effective in supporting the wearer's foot.

Figure 7:
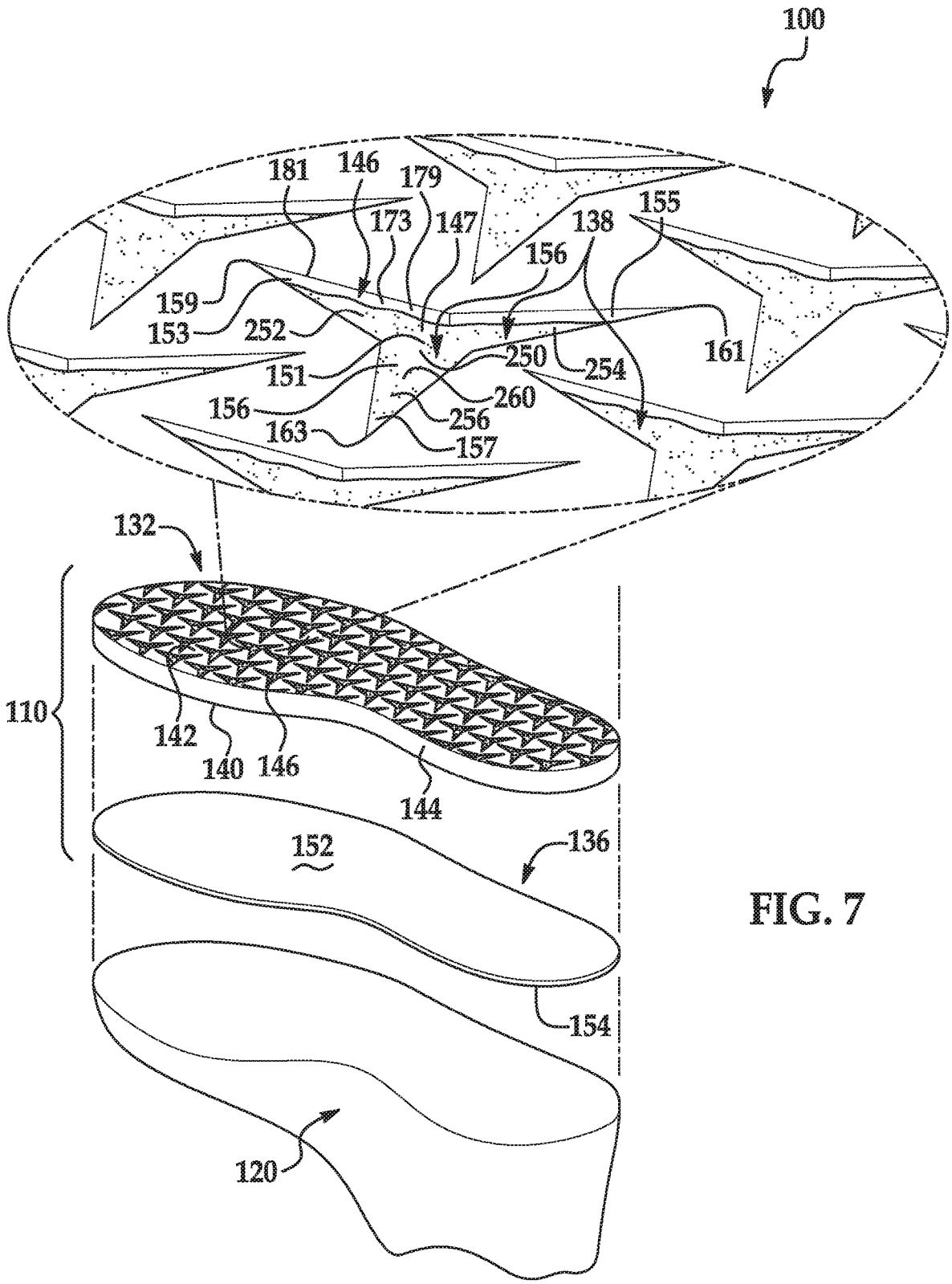
FIG. 7 is an exploded isometric view of a portion of the sole structure of FIG. 1, wherein fillers of the sole structure are shown in detail according to exemplary embodiments.

Referring now to FIGS. 2 and 7, the fillers 138 of the sole structure 110 will be discussed in detail according to exemplary embodiments. The fillers 138 of the sole structure 110 can have various configurations. In general, the fillers 138 can support the wearer's foot. In some embodiments, at least one filler 138 can be partly or wholly received in a respective aperture 146 of the auxetic structure 132. As such, the fillers 138 can provide support to the wearer's foot in these areas of the sole structure 110. Also, the fillers 138 can be deformable in some embodiments. For example, the fillers 138 can be compressible in the vertical direction 107 to thereby support the wearer's foot. Additionally, the fillers 138 can be deformable in the horizontal direction (i.e., in the longitudinal direction 105 and/or the transverse direction 106). The fillers 138 can be compressible and/or expandable in the horizontal direction in some embodiments. Moreover, deformation of the fillers 138 can affect deformation of the auxetic structure 132. In some embodiments, deformation of the auxetic structure 132 can affect deformation of the fillers 138. As such, the fillers 138 and the auxetic structure 132 can deform and/or recover when subjected to a force. Thus, one of these components can push or pull against the other during deformation to benefit the wearer as will be discussed. This can also allow the sole structure to automatically adapt to different types of loading and/or different wearers.

The shape of the fillers 138 will now be discussed in detail according to exemplary embodiments. The shape of the first filler 156 shown in FIGS. 2-4 and 7 will be discussed as a representative example of one or more other fillers 138. As most clearly shown in FIGS. 2 and 7, the filler 156 can correspond in shape substantially to the respective aperture 147 of the auxetic structure 132. Thus, the filler 156 can have a so-called tri-star shape, similar to that of the respective aperture 147. More specifically, as shown in FIGS. 2 and 3, the filler 156 can include a center portion 250 that occupies the center 151 of the aperture 146, a first arm 252 that occupies the first arm 153 of the aperture 146, a second arm 254 that occupies the second arm 155 of the aperture 146, and a third arm 256 that occupies the third arm 157 of the aperture 146. Also, as shown in the embodiment of FIG. 4, the filler 156 can have an upper end 258 that is proximate the top end 175 of the aperture 147, and a lower end 260 that is proximate the bottom end 179 of the aperture 147. The upper end 258 of the filler 156 is closer to the top end 175 than to the bottom end 179 of the aperture 147. The lower end 260 of the filler 156 is closer to the bottom end 179 than to the top end 175 of the aperture 147. As indicated in FIG. 4, the filler 156 can have a height 262 measured from the upper end 258 to the lower end 260 along the vertical direction 107.

In some embodiments, the filler 156 can occupy a majority of the volume of the aperture 147. For example, the filler 156 can span in the horizontal direction (i.e., in the longitudinal direction 105 and the transverse direction 106) to contact opposing portions of the inner wall 173 of the aperture 147. The upper end 258 can be proximate the top rim 177 of the aperture 147. For example, in some embodiments, the upper end 258 can be substantially level and flush with the top rim 177 of the aperture 147. Also, the lower end 260 can be adjacent the bottom end 179 of the aperture 147.

In some embodiments represented in FIG. 4, the filler 156 can partially fill the aperture 147. As such, the filler 156 can cooperate with the inner wall 173 of the aperture 146 to define a recess, pocket, or other space within the aperture 147. For example, as shown in FIGS. 4 and 7, the lower end 260 of the filler 156 can be spaced apart at a distance 264 from the bottom rim 181 of the bottom end 179 of the aperture 147 in some embodiments. Stated differently, the height 262 of the filler 156 can be less than the height 189 of the aperture 147, and the difference between these heights can be equal to the distance 264. The distance 264 can be between approximately three to fifteen millimeters (3-15 mm) in some embodiments. As such, the lower end 260 of the filler 156 can define a recessed space 266 of the ground-facing surface 104 of the sole structure 110. Because it is recessed from surrounding areas of the ground-facing surface 104, the lower end 260 of the filler 156 can be protected from abrasion or other damage due to contact with the ground.

The fillers 138 can be made out of any suitable material. For example, the fillers 138 can include a foam material. In some embodiments, the fillers 138 and the auxetic structure 132 can each be made of a foam material. Additionally, the materials of the auxetic structure 132 can differ from those of the fillers 138 in at least one characteristic (e.g., mechanical property). This difference can cause the fillers 138 to deform differently as compared to the auxetic structure 132. For example, in some embodiments, the material of the fillers 138 can be more easily compressible than the material of the auxetic structure 132. Also, in some embodiments, the material of the fillers 138 can be more easily expandable than the material of the auxetic structure 132.

In some embodiments, the material of the fillers 138 can differ from the material of the auxetic structure 132 in one or more mechanical properties. The term "mechanical property" means properties of a material that involves a reaction to an applied load. As non-limiting examples, mechanical properties include density, firmness, hardness, strength, ductility, impact resistance, fracture toughness, elasticity, and/or resiliency. Specifically, in some embodiments, the fillers 138 can be made from foam, and the auxetic structure 132 can be made from different foam. The foams can differ in hardness, as measured on the Asker Hardness scale. In some embodiments, the foam of the fillers 138 can be between approximately thirty to forty-five (30-45) on the Asker C Hardness scale, whereas the foam of the auxetic structure 132 can be between approximately fifty to sixty-five (50-65) on the Asker C Hardness scale. These hardness ranges properties of the foam materials for the fillers 138 and the auxetic structure 132 allow the fillers 138 to enhance the support provided by the sole structure 100 to the wearer's foot without compromising the auxetic properties of the auxetic structure 132.

Thus, the fillers 138 can be softer, less firm, and less stiff, than the auxetic structure 132 to facilitate the auxetic deformation of the sole structure 100. In other words, the material (e.g., foam material) partly or wholly forming the fillers 138 is softer than the material (e.g., foam material) forming wholly or partly the auxetic structure 132. In some embodiments, one or more mechanical properties of the fillers 138 and/or the auxetic structure 132 can be measured according to ASTM D3574, ASTM D2240, or another equivalent testing standard.

Furthermore, in some embodiments, the fillers 138 can be attached to the auxetic structure 132. For example, the fillers 138 and the inner wall 173 of the auxetic structure 132 can be attached via adhesives. In additional embodiments, the fillers 138 and the auxetic structure 132 can be chemically bonded. As such, there may not be defined boundaries demarcating the exterior surface of the filler 138 and the inner wall 173 of the respective aperture 146; rather, at least part of the exterior surface of the filler 138 and the inner wall 173 of the aperture 146 can be coextensive due to the chemical bonding. Specifically, in some embodiments of the chemical bonding between the fillers 138 and auxetic structure 132, atoms of the filler 138 can be bonded (e.g., via ionic bonds, covalent bonds, etc.) with the atoms of the auxetic structure 132 to achieve the chemical bond between the filler 138 and the auxetic structure 132.

In some embodiments, the fillers 138 can be formed in a process that is separate from that of the auxetic structure 132, and then the fillers 138 can be attached to the auxetic structure 132 in a separate process. In other embodiments, the fillers 138 and the auxetic structure 132 can be formed in a common process, such as a molding process. As the fillers 138 and auxetic structure 132 are molded and then cured, the fillers 138 can attach to the auxetic structure 132. In some embodiments, the sole structure 110 can be manufactured such that the fillers 138 are pre-stressed within the apertures 146. For example, the fillers 138 can be compressed and then fit into the apertures 146 so that the fillers 138 are under compression loads even as the other portions of the sole structure 110 are in a neutral, unstressed configuration. Also, in some embodiments, the filler 138 can be a foam that expands during manufacturing, and the filler 138 can expand against the inner wall 173 of the aperture 146, resulting in the pre-stressing of the fillers 138.

Deformation of the sole structure 110 and, particularly, deformation of the fillers 138 will now be discussed in detail. The fillers 138 can deform as the apertures 146 of the auxetic structure 132 deform. In some embodiments, the inner wall 173 of the representative aperture 146 can push or pull against the corresponding filler 138, causing the filler 138 to deform. Also, in some embodiments, the filler 138 can push or pull against the corresponding inner wall 173, causing the aperture 146 to deform. Accordingly, forces can readily transfer between the filler 138 and the auxetic structure 132 during deformation of the sole structure 110.

Figure 8:
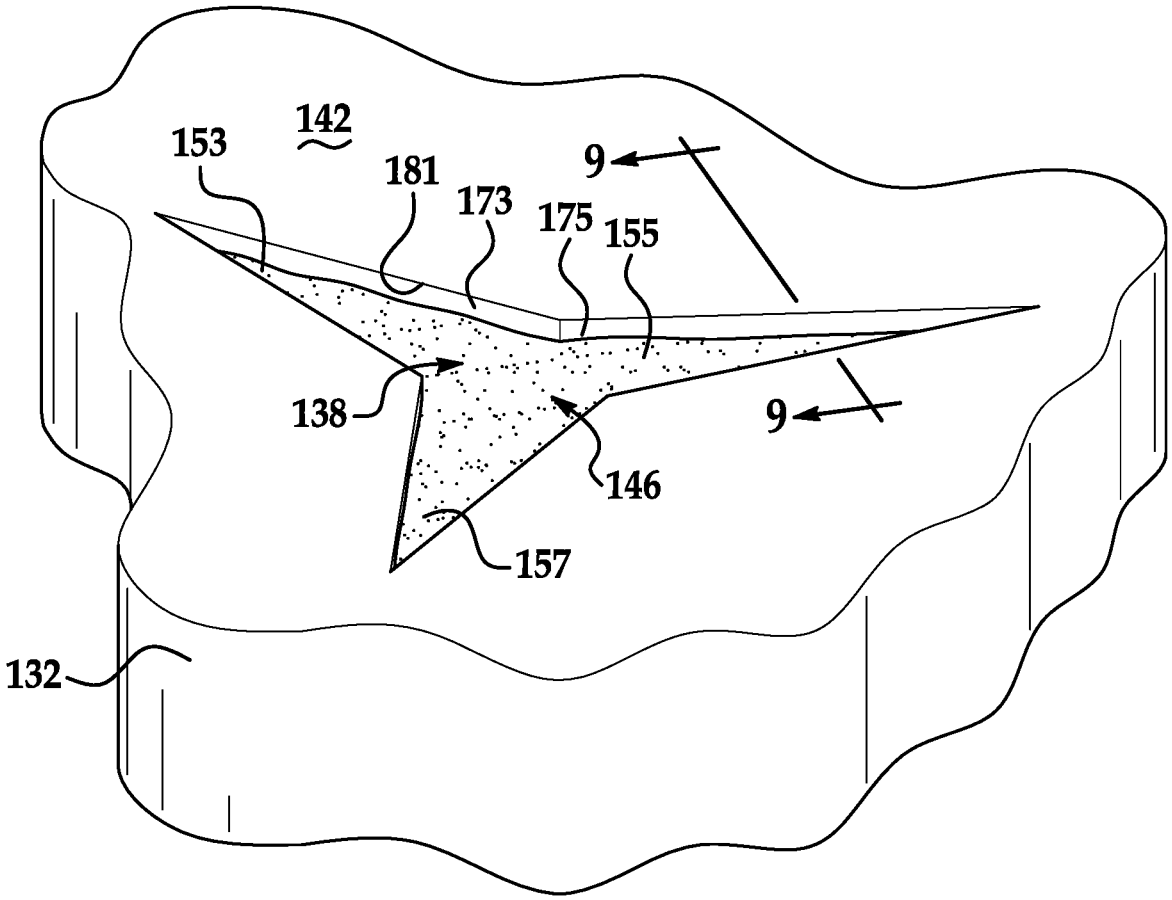
FIG. 8 is an isometric view of an embodiment of an aperture and a filler of the sole structure, shown in a neutral position.
Figure 9:
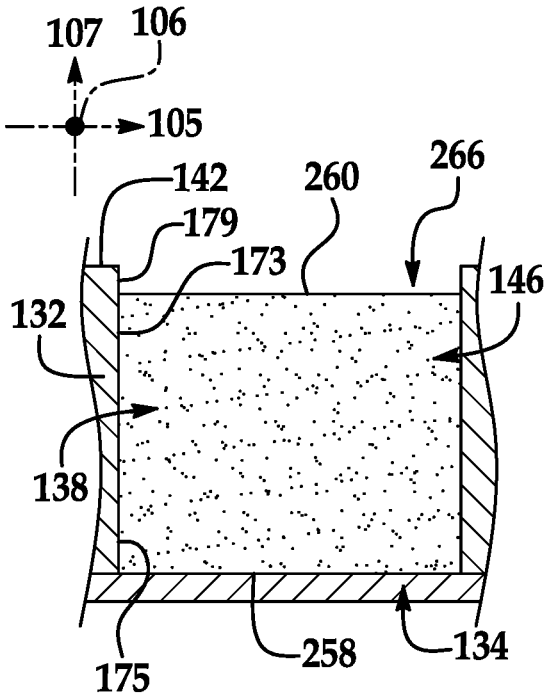
FIG. 9 is a section view of the aperture and filler taken along the line 9-9 of FIG. 8.
Figure 10:
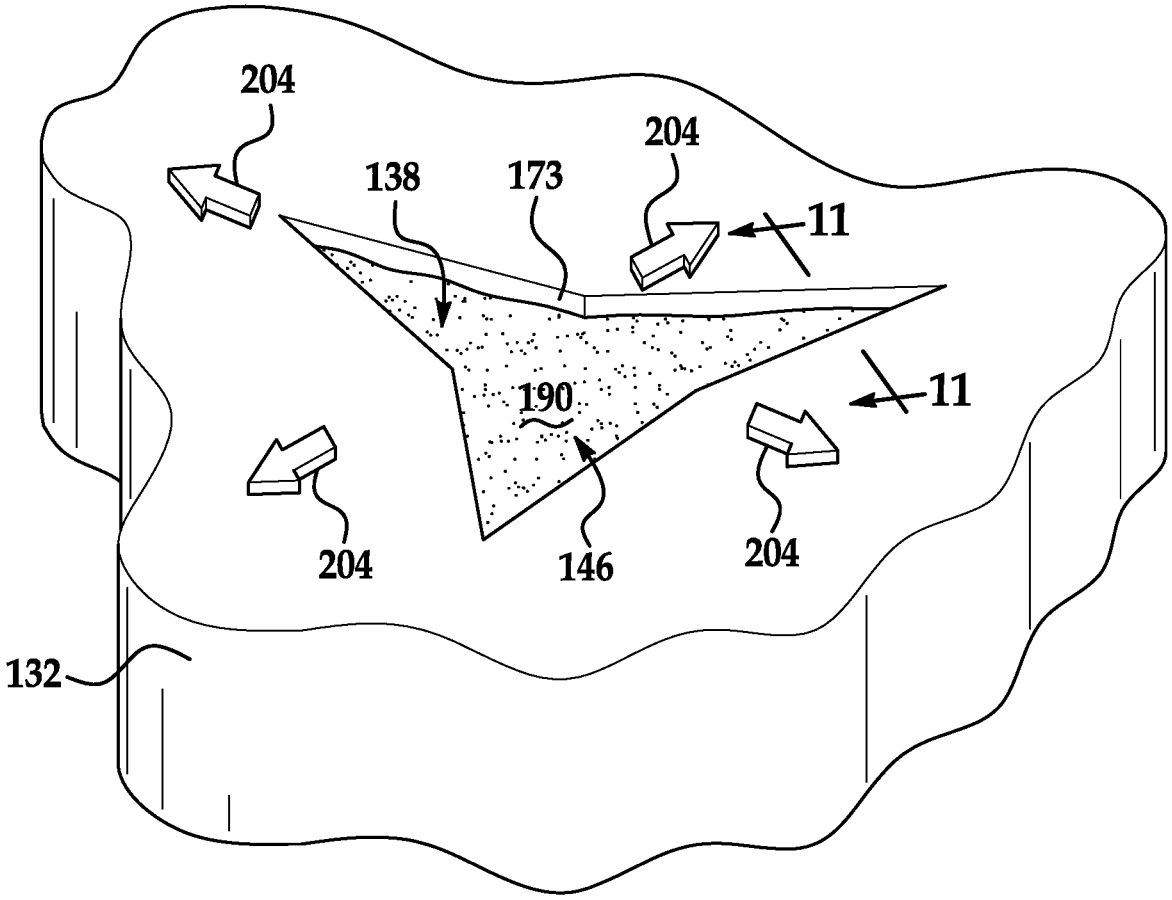
FIG. 10 is an isometric view of the aperture and filler of FIG. 8, shown in an expanded, first deformed position.
Figure 11:
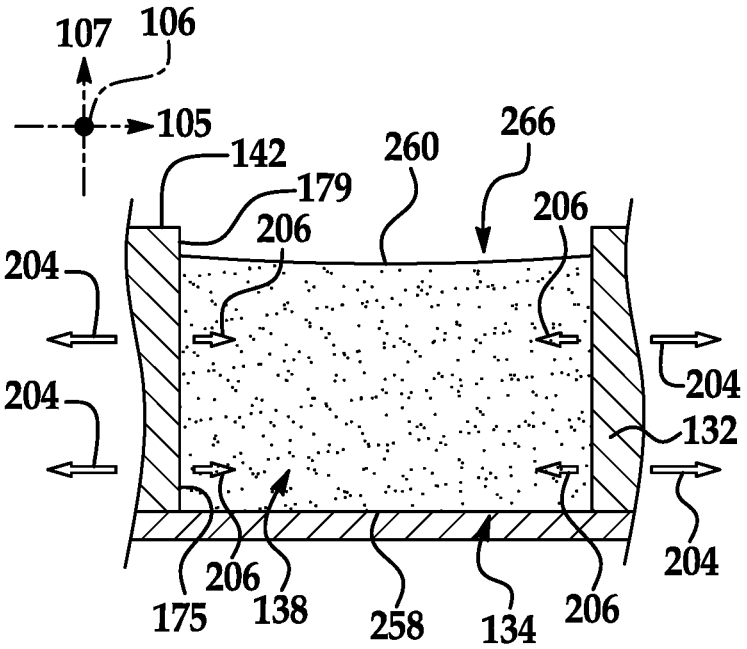
FIG. 11 is a section view of the aperture and filler taken along the line 11-11 of FIG. 10.
Figure 12:
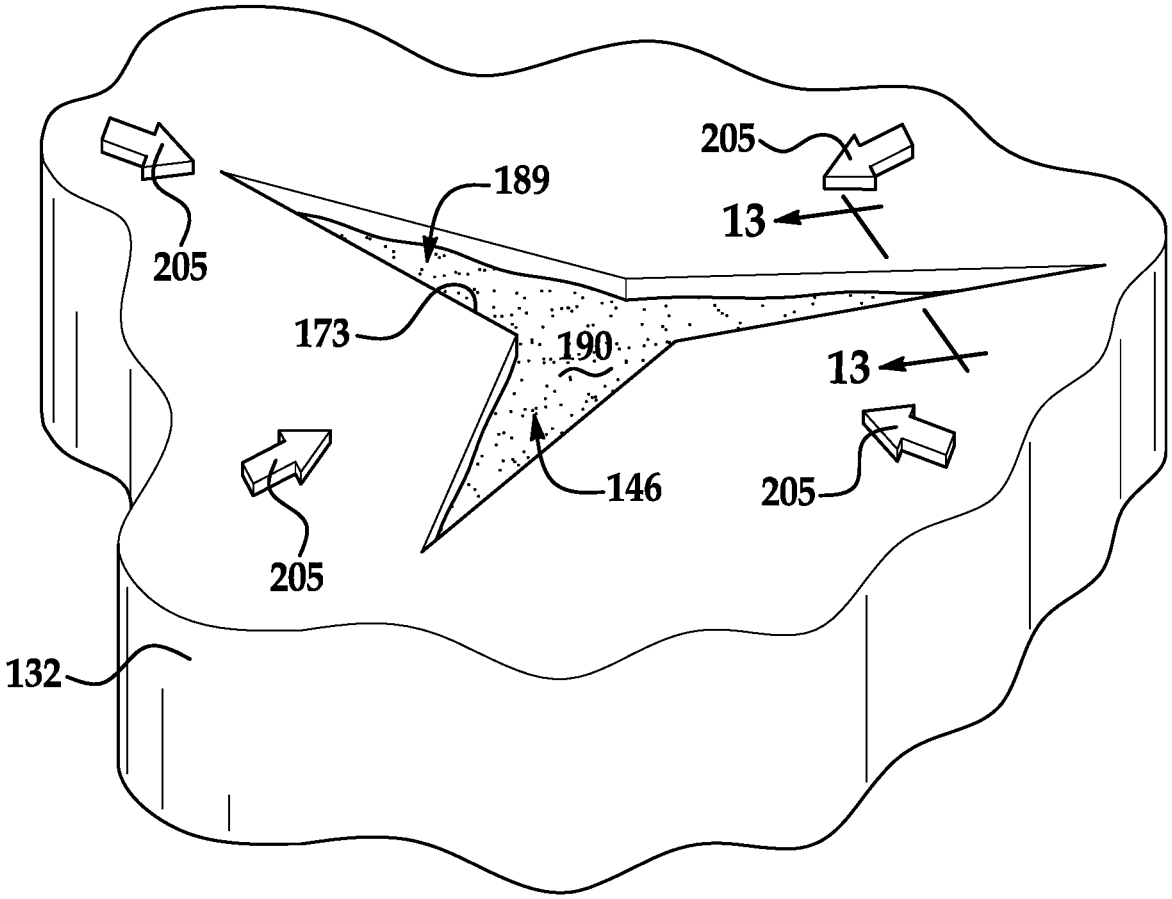
FIG. 12 is an isometric view of the aperture and filler of FIG. 8, shown in a contracted, second deformed position.
Figure 13:
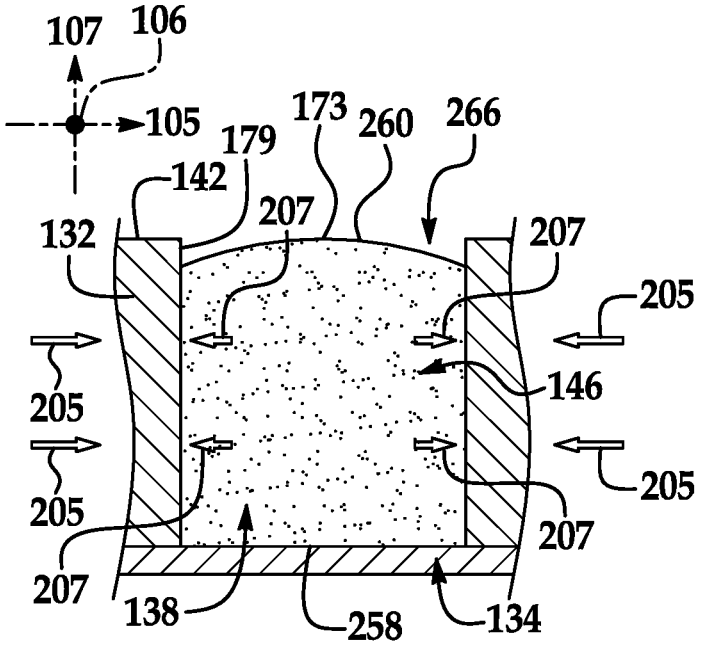
FIG. 13 is a section view of the aperture and filler taken along the line 13-13 of FIG. 12.

Deformation of the filler 138 and auxetic structure 132 will be discussed with reference to FIGS. 8-13 according to exemplary embodiments. FIGS. 8 and 9 illustrate an embodiment of the filler 138, the aperture 146, and the surrounding portion of the auxetic structure 132 at a neutral position. FIGS. 10 and 11 illustrate the same at an expanded position as indicated by arrows 204 and can represent the sole structure 110 at a first deformed position. FIGS. 12 and 13 illustrate the same at a contracted position as indicated by arrows 205 and can represent the sole structure 110 at a second deformed position.

For example, as the sole structure 110 expands from the neutral position of FIGS. 8 and 9 to the deformed position of FIGS. 10 and 11, the filler 138 and the inner wall 173 of the aperture 146 can expand outward in the horizontal direction. In some embodiments, the filler 138 can expand at a lower rate than the auxetic structure 132 in some embodiments. As such, the filler 138 can resist expansion of the aperture 146 to some degree as represented by arrows 206 in FIG. 11. In some embodiments, the resistance provided by the filler 138 can limit the rate of expansion of the aperture 146. In additional embodiments, the filler 138 can have a maximum expanded width, and once that limit is reached, the filler 138 can resist further expansion of the aperture 146. Also, the lower end 260 of the filler 138 can bow inward and become concave in some embodiments as illustrated in FIG. 13.

These differences in expansion between the filler 138 and the auxetic structure 132 can result from the differences in material characteristics (e.g., differences in density, durometer, elasticity, material expansion rate, etc.). These differences can also result from the particular geometries of the filler 138 and auxetic structure 132.

This behavior can benefit the wearer in various ways. For example, the sole structure 110 can stretch and expand and deform in concert with movements of the foot. However, the resistance provided by the fillers 138 can limit the stretching so that the sole structure 110 can still support the foot.

In contrast, as the sole structure 110 contracts from the neutral position of FIGS. 8 and 9 to the deformed position of FIGS. 12 and 13, the inner wall 173 of the aperture 146 can compact and compress the filler 138 as indicated by arrows 205. In some embodiments, the filler 138 can increase in density during this compression. For example, the filler 138 can be compressed as the aperture 146 contracts and reduces in volume to thereby increase the density of the filler 138. In some embodiments, the filler 138 can resist the contraction of the aperture 146 as indicated by arrows 207. Also, the lower end 260 of the filler 138 can bow outward from the aperture 146 and become convex in some embodiments as indicated in FIG. 13.

These differences in contraction between the filler 138 and the auxetic structure 132 can result from the differences in material characteristics (e.g., differences in density, durometer, elasticity, material expansion rate, etc.). These differences can also result from the particular geometries of the filler 138 and auxetic structure 132.

This behavior can benefit the wearer, for example, by providing cushioning and/or other types of support for the foot. For example, compression of the sole structure 110 can cause the aperture 146 to contract, thereby compressing the filler 138. The density of the filler 138 can increase during compression. As the density increases, the filler 138 can become less pliable and can provide increased cushioning and support to the foot.

In some embodiments, support provided by the sole structure 110 can adapt according to the applied forces and/or according to the particular wearer. For example, a wearer that strikes particularly hard against the ground in the heel region 114 (i.e., a "heel-striker") can compress the sole structure 110 to a high degree in the vertical direction 107. As a result, the heel region 114 can deform to a high degree in the heel region 114, causing contraction of the apertures 146 and fillers 138. This can result in an increase to the normal amount of cushioning and support within the heel region 114.

Likewise, if a wearer cuts and changes direction by pushing off the ground to a high degree in the midfoot region 112, the apertures 146 within the midfoot region 112 can expand to a high degree. However, the corresponding fillers 138 can limit this expansion. Thus, the midfoot region 112 can resist stretching and provide firmer footing for the wearer.

Accordingly, the sole structure 110 can adapt and "tune" to the needs of the wearer. The sole structure 110 can provide increased cushioning in particular areas of the sole structure 110. Also, the sole structure 110 can provide increased stiffness and increased stretch resistance in particular areas of the sole structure 110.

Figure 14:
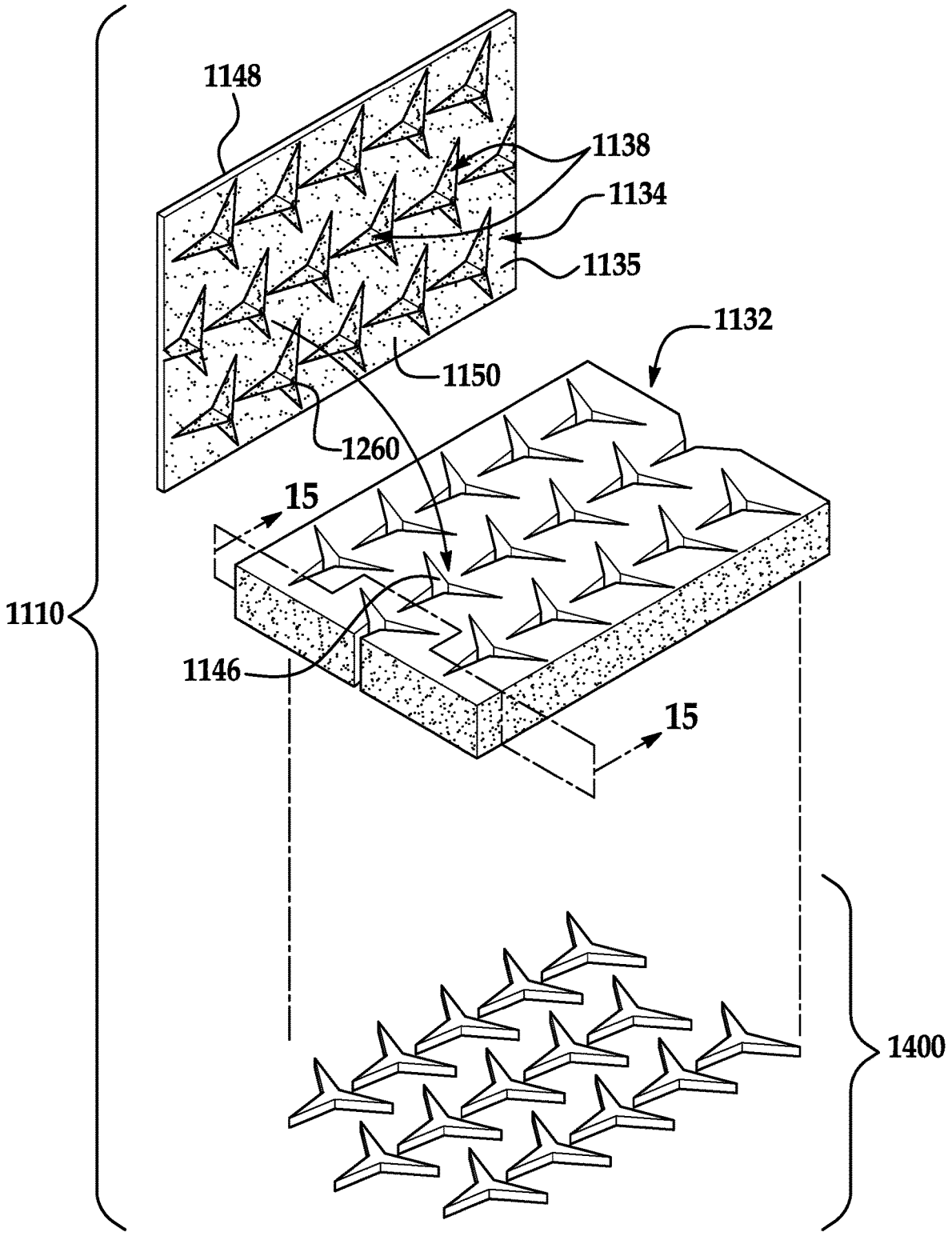
FIG. 14 is an exploded, isometric view of a portion of the sole structure shown according to additional embodiments of the present disclosure.
Figure 15:
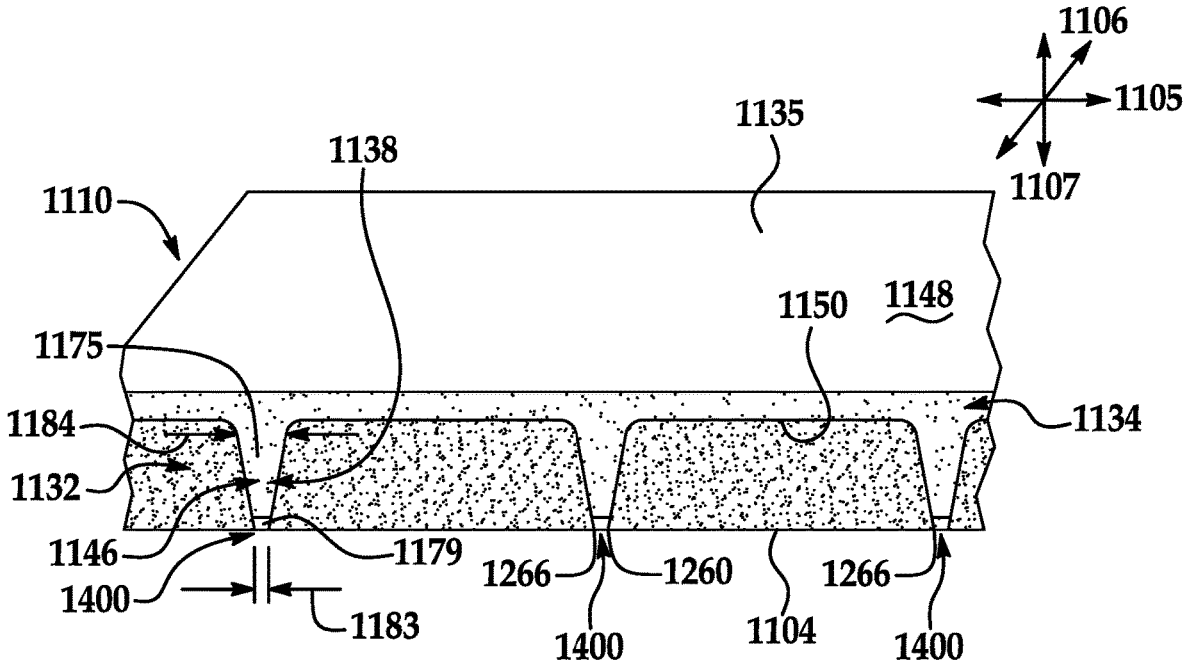
FIG. 15 is a section view of the portion of the sole structure of FIG. 14 taken along the line 15-15 of FIG. 14.

Referring now to FIGS. 14-15, additional embodiments of the sole structure 1110 are illustrated according to exemplary embodiments. For purposes of clarity, only a localized portion of the sole structure 1110 is shown instead of the entire sole structure 1110. Also, components that correspond to the embodiments of FIGS. 1-13 are indicated with corresponding reference numbers increased by 1000.

As shown in the exploded view of FIG. 14, the sole structure 1110 can include the auxetic structure 1132 similar to the embodiments discussed above. However, one or more apertures 1146 can be different from the embodiments discussed above. For example, the width 1183 between opposing areas of the aperture 1146 is shown in FIG. 15. The width 1183 can vary along the thickness direction 1107 between the top end 1175 and the bottom end 1179 of the aperture 1146. In some embodiments, the width 1183 of the aperture 1146 can taper gradually between the top end 1175 and the bottom end 1179. Specifically, as shown in FIG. 15, the width 1183 at the bottom end 1179, proximate (or at) the ground-facing surface 1104, can be less than the width 1184 at the top end 1175 of the aperture 1146.

Also, as shown in FIGS. 14 and 15, the sole structure 1110 can include the pad 1134 and the plurality of fillers 138. The sole structure 1110 can extend along a longitudinal direction 1105, a transverse direction 1106, and a thickness direction 1107 (or vertical direction). In some embodiments, the pad 1134 and the fillers 1138 can be attached. Specifically, in some embodiments, the pad 1134 and the fillers 1138 can be integrally attached to define a unitary, one-piece support body 1135. As such, the pad 1134 and fillers 1138 can be made from and/or include the same materials, such as a unitary foam material. The pad 1134 has a top surface 1148 and a bottom surface 1150 opposite the top surface 1148. The fillers 1138 can project from the bottom surface 1150 of the pad 1134, and the fillers 1138 can have a shape and positioning that corresponds to the apertures 1146. Thus, the fillers 1138 can have an inverse shape to that of the respective apertures 1146. Additionally, the fillers 1138 can be spaced apart across the pad 1134 to be received within the respective apertures 1146. When assembled, the pad 1134 can be disposed outside the apertures 1146 of the auxetic structure 1132, and the fillers 1138 can be received within the apertures 1146.

The sole structure 1110 can additionally include one or more plugs 1400. The plugs 1400 can be relatively small and configured to be received within the aperture 1146. In some embodiments, the plugs 1400 can be made out of polymeric material. For example, the plugs 1400 can be made out of rubber or other high strength and/or high friction material. Additionally, in some embodiments, the plugs 1400 can include a plurality of web-like members that are bunched to define the respective plug 1400.

As shown in FIGS. 14 and 15, the plugs 1400 can be received in respective ones of the apertures 1146. In some embodiments, the plugs 1400 can be received in the bottom end 1179 of the apertures 1146. Specifically, at least one plug 1400 can be received in the space 1266 defined between the lower end 1260 of the filler 1138 and the bottom end 1179 of the respective aperture 1146. As shown in FIG. 15, the plug 1400 can substantially fill the majority of the space 1266. As such, the plugs 1400 can partly define the ground-facing surface 1104 of the sole structure 1110. Accordingly, in some embodiments, the plug 1400 can protect the lower end 1260 of the filler 1138 from abrasion, from sharp objects on the ground, or other damage.

Figure 16:
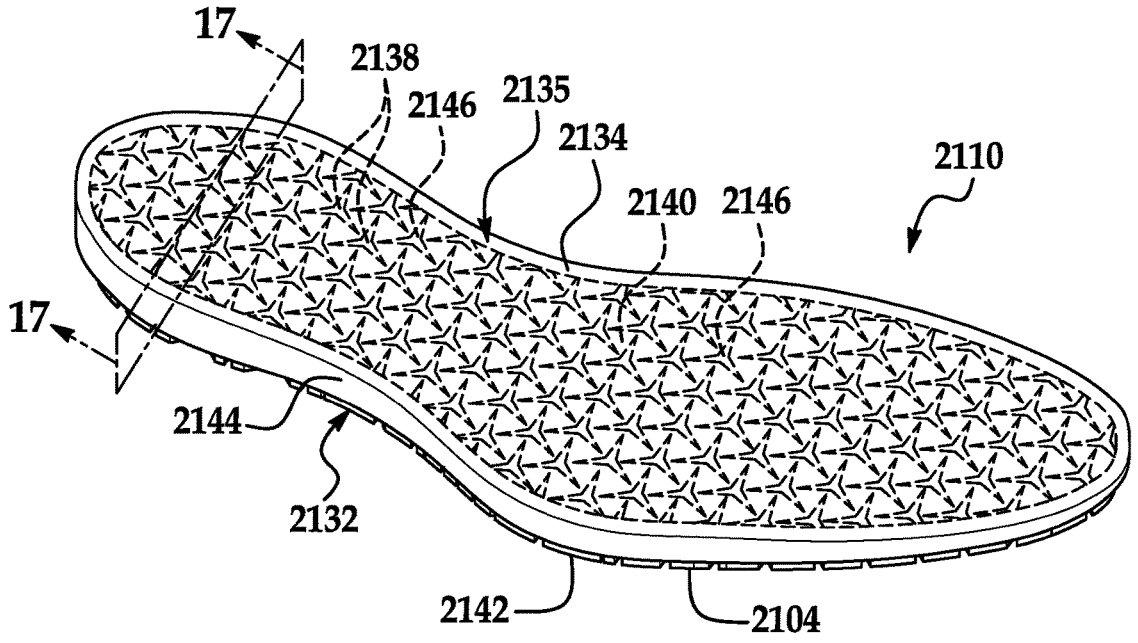
FIG. 16 is a perspective view of the sole structure according to additional embodiments of the present disclosure.
Figure 17:
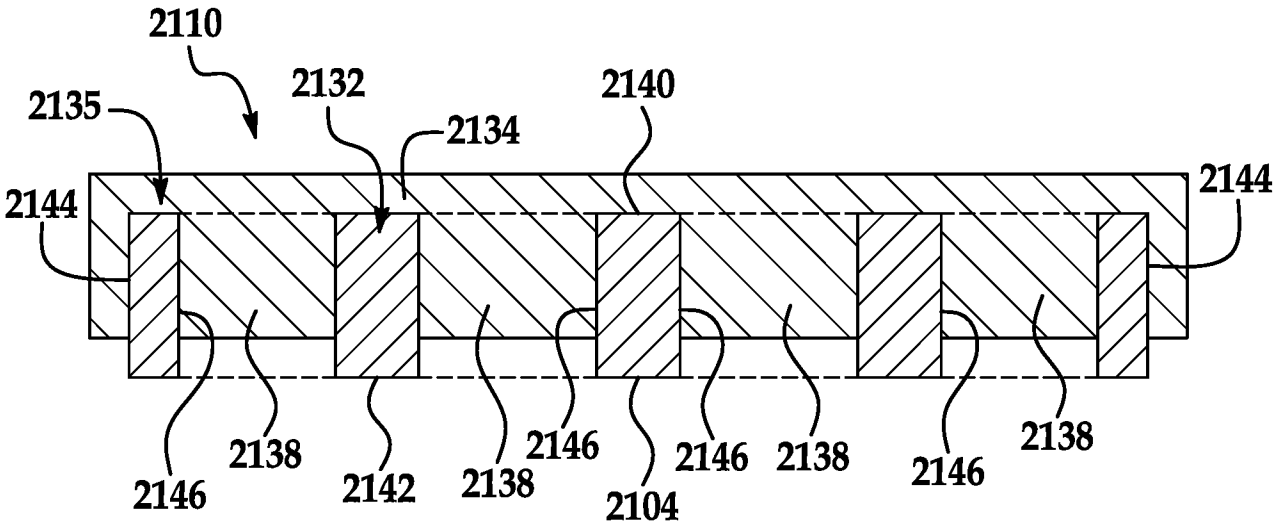
FIG. 17 is a section view of the sole structure taken along the plane 17-17 of FIG. 16.

Referring now to FIGS. 16 and 17, additional embodiments of the sole structure 2110 are illustrated according to exemplary embodiments. Components that correspond to the embodiments of FIGS. 1-13 are indicated with corresponding reference numbers increased by 2000.

As shown in FIGS. 16 and 17, the sole structure 2110 can include the auxetic structure 2132 and the support body 2135. The support body 2135 can include the pad 2134 and the fillers 2138. Also, in some embodiments, the support body 2135 can be a unitary, one-piece body, wherein the pad 2134 and the fillers 2138 are integrally attached.

Additionally, in some embodiments, the auxetic structure 2132 can be at least partly embedded within the support body 2135. As such, the fillers 2138 of the support body 2135 can be received in the apertures 2146 of the auxetic structure 2132, and the pad 2134 can be disposed over the auxetic structure 2132.

Specifically, as shown in the embodiment of FIGS. 16 and 17, the upper portion of the auxetic structure 2132, including the upper surface 2140 and part of the outer periphery 2144, can be embedded and surrounded by the support body 2135. Also a lower portion of the auxetic structure 2132, including the lower surface 2142, can be exposed from and spaced apart from the support body 2135. Thus, the lower surface 2142 of the auxetic structure 2132 can define the ground-facing surface 2104 of the sole structure 2110 in some embodiments.

It will be appreciated that the auxetic structure 2132 can be embedded in the support body 2135 differently without departing from the scope of the present disclosure. For example, in some embodiments, the auxetic structure 2132 can be encapsulated within the support body 2135. As such, all or substantially all of the auxetic structure 2132 can be covered and surrounded by the support body 2135.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An article of footwear comprising:

an upper defining a cavity, wherein the cavity is configured to receive a foot; and a sole structure attached to the upper, wherein the sole structure includes:

a ground-facing surface and a top surface that faces opposite the ground-facing surface;

an auxetic structure formed from a first foam material, the auxetic structure having a negative Poisson's ratio such that the auxetic structure expands in both a lateral direction of the sole structure and in a longitudinal direction of the sole structure when the auxetic structure is tensioned in either the longitudinal direction or the lateral direction, wherein the negative Poisson's ratio is attributable to an arrangement of a plurality of apertures across the auxetic structure, each aperture of the plurality of apertures extending through the first material from the top surface to the ground-facing surface, and wherein each aperture of the plurality of apertures has a respective inner wall; and a plurality of discrete foam fillers formed from a second foam material that is softer than the first foam material, each foam filler of the plurality of discrete foam fillers being provided within a corresponding one of the plurality of apertures, and wherein each foam filler of the plurality of discrete foam fillers has a respective surface that is flush with at least one of the top surface or ground-facing surface and is attached to the inner wall;

wherein the sole structure is configured to deform from a neutral position to a deformed position in response to an applied tension;

wherein each aperture of the plurality of apertures and each filler provided with the corresponding aperture expand in both the lateral direction and the longitudinal direction as the sole structure deforms from the neutral position to the deformed position.

2. The article of footwear of claim 1, wherein the first foam material has a hardness between fifty and sixty-five (50-65) Asker C Hardness; and wherein the second foam material has a hardness between thirty and forty-five (30-45) Asker C Hardness.

3. The article of footwear of claim 1, wherein each of the fillers is chemically bonded to the auxetic structure.

4. The article of footwear of claim 1, wherein each aperture of the plurality of apertures has a volume, and wherein each filler of the plurality of foam fillers occupies a majority of the volume of the respective aperture that the foam filler is provided in.

5. The article of footwear of claim 1, wherein each aperture of the plurality of apertures includes a first end and a second end, the inner wall extends in a thickness direction between the first end and the second end, the first end is closer to the ground-facing surface than to the top surface, and wherein the second end is closer to the top surface than to the ground-facing surface; and wherein each filler of the plurality of foam fillers includes an upper end and a lower end, wherein the upper end is closer to the second end of the aperture than to the first end of the respective aperture that the foam filler is provided in, and the lower end is spaced apart at a distance from the first end of the respective aperture that the foam filler is provided in.

* * * * *